US007497774B2

(12) United States Patent
Stevenson et al.

(10) Patent No.: US 7,497,774 B2
(45) Date of Patent: Mar. 3, 2009

(54) WHOLE HOUSE FAN SYSTEM AND METHODS OF INSTALLATION

(75) Inventors: Dana Charles Stevenson, Winchester, CA (US); Ronnie Keith Stone, Murrieta, CA (US)

(73) Assignee: QC Manufacturing, Inc., Winchester, CA (US)

( * ) Notice: Subject to any disclaimer, the term of this patent is extended or adjusted under 35 U.S.C. 154(b) by 0 days.

(21) Appl. No.: 11/181,669

(22) Filed: Jul. 13, 2005

(65) Prior Publication Data

US 2006/0035581 A1 Feb. 16, 2006

Related U.S. Application Data

(60) Provisional application No. 60/587,537, filed on Jul. 13, 2004.

(51) Int. Cl.
*F24F 7/06* (2006.01)
*F24F 7/007* (2006.01)
*F24F 7/013* (2006.01)

(52) U.S. Cl. ..... 454/354; 454/341; 454/346; 454/349; 454/903; 454/906

(58) Field of Classification Search ..... 454/248, 454/343, 346, 349, 354, 341, 903, 906
See application file for complete search history.

(56) References Cited

U.S. PATENT DOCUMENTS 1,924,489 A 8/1933 Ferris
2,011,421 A * 8/1935 Searles ..... 126/110 R
2,191,774 A 2/1940 Reed
2,278,581 A * 4/1942 MacDougald ..... 454/354
2,299,833 A * 10/1942 Mader ..... 454/344
2,349,627 A 5/1944 Kemmer et al.
2,464,000 A 3/1949 Schild
2,544,379 A 3/1951 Davenport (Continued)

FOREIGN PATENT DOCUMENTS

JP 57062341 A * 4/1982

(Continued)

OTHER PUBLICATIONS

H.G. Alt; "Air Conditioning Simplified"; Domestic Engineering vol. 143, No. 3, p. 76; 1934. *Reprinted from "Comfort Cooling with Attic Fans" by G.B. Helmrich and G.H. Tuttle.*

(Continued)

*Primary Examiner*—Steven B McAllister
*Assistant Examiner*—Patrick F. O'Reilly, III
(74) *Attorney, Agent, or Firm*—Knobbe, Martens, Olson & Bear LLP

(57) ABSTRACT

A whole house fan system and installation methods configured to reduce noise generated by the fan are provided. The system generally includes a fan, a register, and a flexible duct extending between the fan and the register. The flexible duct has acoustical insulation properties, which helps to reduce sound transmission from the fan to the register. The fan system is configured to be mounted in the attic space of a house. The fan motor is suspended in the attic so that it does not have direct contact with any part of the building structure.

12 Claims, 3 Drawing Sheets

U.S. PATENT DOCUMENTS

| | | | | | |
|---|---|---|---|---|---|
| 2,612,831 | A | * | 10/1952 | Lohman, Jr. | 454/343 |
| 3,199,433 | A | | 8/1965 | Bosma, Jr. et al. | |
| 4,261,255 | A | * | 4/1981 | Anderson et al. | 454/354 |
| 4,372,196 | A | * | 2/1983 | Henderson | 454/349 |
| 4,375,183 | A | * | 3/1983 | Lynch | 454/292 |
| 4,385,550 | A | * | 5/1983 | Steiner et al. | 454/354 |
| 4,502,467 | A | * | 3/1985 | Smith | 126/586 |
| 4,776,385 | A | * | 10/1988 | Dean | 165/248 |
| 4,939,986 | A | | 7/1990 | Turner | |
| 4,955,997 | A | * | 9/1990 | Robertson, III | 96/138 |
| 5,092,520 | A | | 3/1992 | Lestage | |
| 5,306,207 | A | | 4/1994 | Court | |
| 5,620,368 | A | | 4/1997 | Bates et al. | |
| 5,720,661 | A | | 2/1998 | Yoshizawa et al. | |
| 5,957,506 | A | * | 9/1999 | Stepp | 285/183 |
| 6,203,422 | B1 | | 3/2001 | Rosal et al. | |
| 6,267,667 | B1 | * | 7/2001 | Fikes | 454/343 |
| 6,287,191 | B1 | * | 9/2001 | Barker, II | 454/248 |
| 6,322,443 | B1 | * | 11/2001 | Jackson | 454/329 |
| 6,328,776 | B1 | * | 12/2001 | Shanks et al. | 55/385.2 |
| 6,524,182 | B2 | | 2/2003 | Kilburn et al. | |
| 6,537,146 | B1 | * | 3/2003 | Haynes | 454/290 |

FOREIGN PATENT DOCUMENTS

| | | | | |
|---|---|---|---|---|
| JP | 58-208527 | A | | 5/1983 |
| JP | 58-208528 | A | | 5/1983 |
| JP | 59-041734 | A | | 8/1984 |
| JP | 2000002457 | A | * | 1/2000 |

OTHER PUBLICATIONS

Print-Out of Quietcoolfan.com website, Sep. 2003.

* cited by examiner

WHOLE HOUSE FAN SYSTEM AND METHODS OF INSTALLATION

RELATED APPLICATIONS

This application claims the benefit of U.S. Provisional Patent Application Ser. No. 60/587,537 filed Jul. 13, 2004, the entirety of which is hereby incorporated by reference.

BACKGROUND OF THE INVENTION

1. Field of the Invention

This invention relates generally to cooling and ventilation systems for building structures, and more particularly, relates to a low noise whole house fan system and methods of installation.

2. Description of the Related Art

Fans, air conditioners, and various other systems have been developed for cooling and ventilating residential and commercial building structures. Most fan systems are designed to create airflow inside a building. One such type of fan system is a whole house fan system. Whole house fan systems generally operate by drawing cooler air from outside through open windows and doors into the living area of a house. The fan is typically mounted adjacent to an opening formed in the ceiling and draws cooler air in from outside. The cooler air is then routed through the living area and forced up through the ceiling into the attic where it is exhausted out through a vent. Louvered shutters are often placed over the vent to prevent cooled or heated air from escaping when the fan is not in use.

Traditional whole house fans are usually large fans installed on the attic floor flush with the ceiling of the house. In operation, these fans tend to generate quite a bit of noise because of their large size. Moreover, vibrations due to the fan being mounted directly on a portion of the building structure can also generate undesirable noise. It is thus an object of the present invention to provide a whole house fan system which will overcome or ameliorate one or more of the disadvantages of the prior art systems.

SUMMARY OF THE INVENTION

In one aspect, the preferred embodiments of the present invention provide a whole house fan system for building structures. The whole house fan system comprises a fan having a plurality of fan blades and a motor, an air admitting device configured to be positioned in an opening formed in a ceiling of the building structure, and an elongated, flexible acoustically insulating material extending between the fan and the air admitting device. Preferably, the air admitting device is a register, diffuser or similar device. The material preferably defines an air passageway between the fan and the register. In one embodiment, the fan is a duct fan. In another embodiment, the fan is a propeller fan. In yet another embodiment, the system further comprises a damper, wherein the damper has a plurality of shutters that can be moved to a close position by gravity. Preferably, the damper is made of a heat insulating material and the flexible acoustically insulating material is an acoustically insulating duct. In one embodiment, the fan motor is preferably positioned inside the duct.

In another aspect, the preferred embodiments of the present invention provide a method of installing a whole house fan system in a building structure. The method comprises forming an opening in a ceiling of the building structure, positioning a fan a first distance from the opening, extending a flexible, sound insulating duct between the fan and the opening. Preferably, the method also includes suspending the fan so that the fan does not directly contact any portion of the building structure. In one embodiment, the fan is suspended on a roof rafter. In another embodiment, the method further comprises positioning a diffuser in the opening in the ceiling.

DETAILED DESCRIPTION OF THE PREFERRED EMBODIMENT

Figure 1:
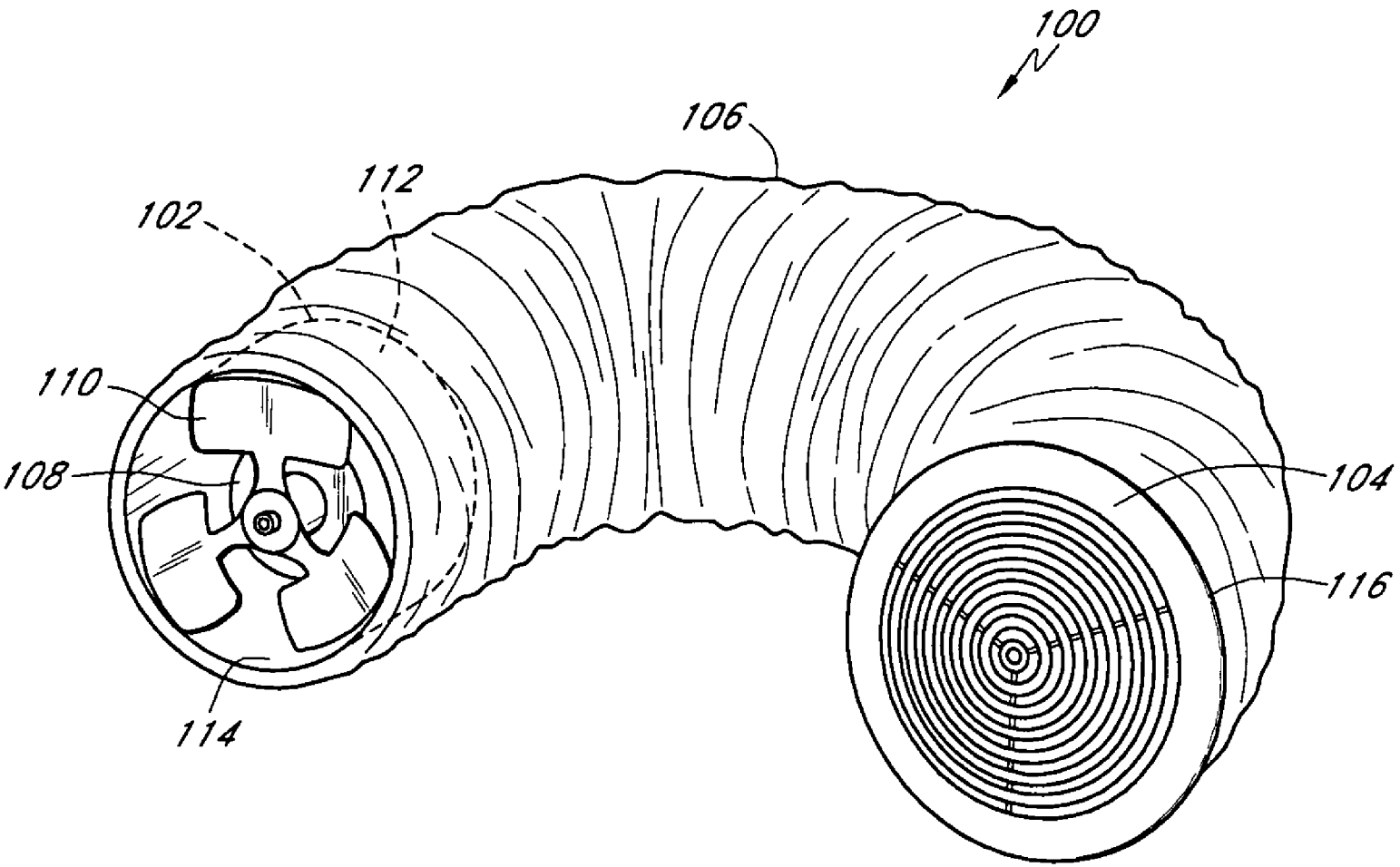
FIG. 1 is a schematic illustration of a whole house fan system of one preferred embodiment of the present invention.

FIG. 1 is a schematic illustration of a whole house fan system 100 of one preferred embodiment of the present invention. As shown in FIG. 1, the system 100 generally comprises a fan 102, a register or diffuser 104, and a flexible duct 106 extending therebetween. In one embodiment, the fan 102 is comprised of an electric motor 108 and a fan blade system 110 surrounded by a reducing venturi collar 112. In a preferred embodiment, the fan 102 can be a propeller fan, a radial mounted duct fan, or any other similar types of fan. The register or diffuser 104 can also be a grille or any other device that admits air into a space for ventilation purposes. The duct 106 is preferably a flexible, acoustically insulating duct designed to reduce transmission sound therethrough.

As shown in FIG. 1, the fan 102 and the register 104 are spaced apart by the acoustically insulating duct 106, which reduces transmission of the sound generated by the fan through the register. In the embodiment shown in FIG. 1, the fan is positioned inside the duct 106 adjacent to a first end 114 of the duct 106 while the register or diffuser 104 is positioned adjacent to a second end 116 of the duct 106. The register or diffuser 104 can be mounted on a ceiling or wall in a manner to be described in greater detail below. The acoustically insulative property of the duct 106 further reduces sound transmission from the fan 102 to the register 104.

Figure 2:
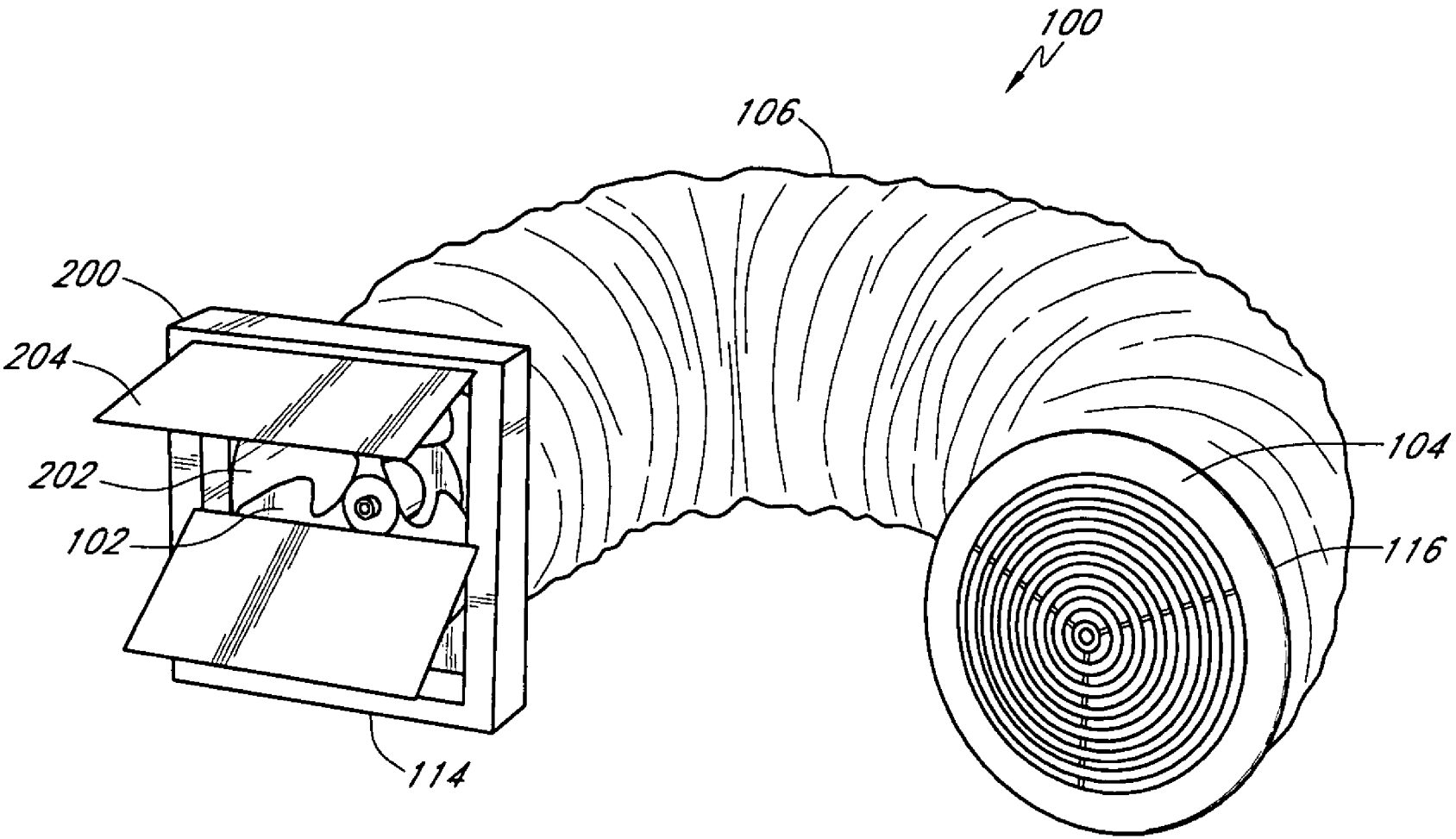
FIG. 2 is a schematic illustration of a whole house fan system of another preferred embodiment.

FIG. 2 shows another embodiment of the whole house fan system 100. In this embodiment, the system 100 also includes a damper 200 mounted adjacent to the first end 114 of the duct 106, preferably adjacent to the fan 102. The damper 200 can be mounted using techniques known in the art. In one embodiment, the damper 200 has an opening 202 and a plurality of hinged shutters 204 positioned adjacent the opening 202. The hinged shutters 204 are moved to a closed position by gravity when the fan 102 is not operating, thereby covering the opening 202. When the fan 102 is operating, air flow generated by the fan 102 forces the shutters 204 open, thereby allowing air to flow out of the duct 106. In a preferred embodiment, the shutters 204 are made of an insulating material so that when they are closed, they substantially prevent the escape of cooled or heated air through the duct 106.

Figure 3:
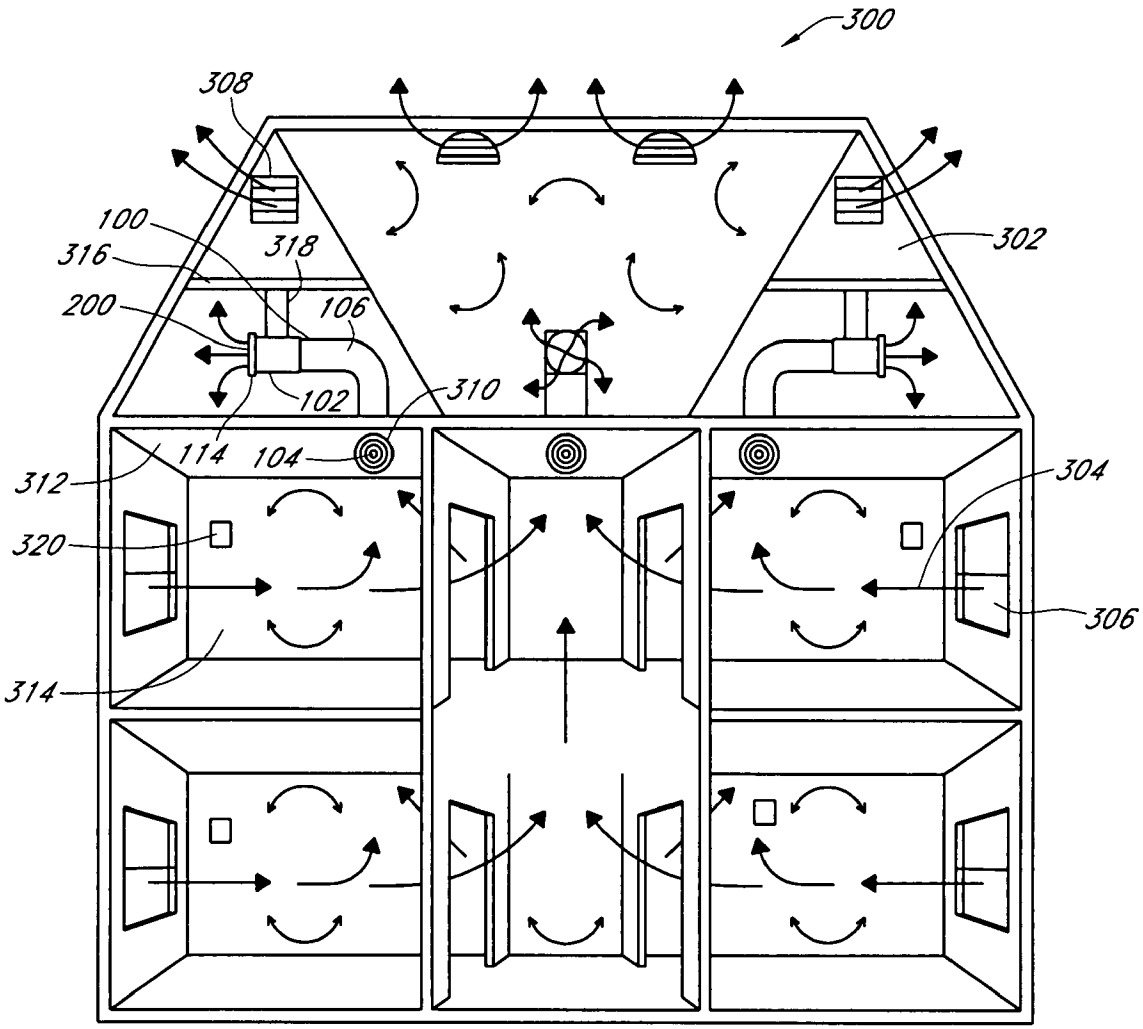
FIG. 3 is a partial sectional view of a building structure showing the whole house fans system of FIG. 2 installed therein to cool the building structure.

FIG. 3 is a partial sectional view of a building structure 300 showing the whole house fan system 100 installed therein to cool the building structure. In the embodiment shown in FIG. 3, the building structure 300 is a two-story residential house.

As shown in FIG. 3, the whole house fan system 100 is mounted in an attic space 302 of the house. Preferably, the fan system 100 is capable of creating a sufficient suction to draw cool outside air 304 through an open window 306, circulate the air to different parts of the house 300, and force the air up the attic 302 and exhaust through a vent 308 in the attic. As shown in FIG. 3, the register or diffuser 104 is preferably placed in an opening 310 formed in a ceiling 312 between the attic space 302 and an upstairs room 314 or any other room that is directly below the attic space. As also shown in FIG. 3, the fan blades and motor 102 are preferably suspended on a roof rafter 316 in the attic space 302. In one embodiment, the fan blades, fan motor along with the first end 114 of the duct 106 are suspended by flexible straps 318 that are attached to the roof rafter 316. Advantageously, the fan 102 is thus not in direct contact with a part of the building structure, which greatly reduces the noise generated by vibration of the fan. As FIG. 3 further shows, the fan 102 is positioned a first distance away from the register or diffuser 104. In a preferred embodiment, the first distance can be about 8 feet, 6 feet, 4 feet, or 2 feet.

As also shown in FIG. 3, the whole house fan system 100 can be positioned to regulate cooling of individual rooms of the house. The system 100 can include a control 320 mounted on the wall of each room of the house. The control 320 can be a wall mounted toggle or timer switch and the like. The fan systems 100 for each individual room can be turned on or off, thereby providing the capability of controlling the cooling of individual rooms. In some embodiments, the system 100 utilizes a single large fan. In other embodiments, the system 100 can include a plurality of smaller fans as shown in FIG. 3. In operation, when the system 100 is turned off for a particular room, the gravity operated damper 200 closes off the duct 106 to substantially prevent air in the attic from entering the living area and substantially reduce the transfer of heat or cold into the living area through radiation. When the fan system 100 is turned on, the rotating fan lessens the static air pressure in the living area so that when a window or door is opened, air is drawn into the living space and then pushed into the attic, thereby increasing the static air pressure in the attic.

The whole house fan systems of the preferred embodiments provide numerous advantages that are not present in the traditional whole house fan systems. For example, the fan blades and motor are installed in a manner such that they are suspended and not in direct contact with any portion of the building structure. This greatly reduces noise caused by vibration of the fan and motor. Additionally, the fan motor and register are separated by a duct having acoustical insulation properties. The acoustical duct further diminishes transmission of noise generated by the fan or air flow to the living space of the house. Certain embodiments of the system also include a damper that can be closed by gravity when the fan is not in operation. This substantially minimizes transfer of heat between the attic and the living areas of the building structure when the system is not in use. Moreover, the system also provides the option of individually controlling air flow through each room of the house. Instead of using one large centrally located fan, the system provides the option of utilizing a multi-fan system, thereby allowing selectively cooling certain rooms of the house.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. A whole house fan system for building structures having a dwelling area and an attic, wherein the attic has at least one rafter, said whole house fan system comprising:

a fan having a plurality of fan blades and a motor, wherein the fan lessens the static air pressure in the dwelling area by actively drawing air from the dwelling area and then pushing the air into the attic, wherein the lessened static air pressure in the dwelling area allows external cooler air to be drawn into the dwelling area through an open window or door;

a venturi collar, said venturi collar surrounds the fan blades and is adapted to reduce the noise level generated by the air flow;

an air admitting device, said device configured to be positioned in an opening formed in a ceiling of a building structure;

an elongated, flexible acoustically insulating material extending between the fan and the air admitting device, said material defining an air passageway between the fan and the air admitting device, wherein the insulating material is sufficiently long such that a first end of the insulating material is adapted to positioned adjacent to the ceiling and a second end of the insulating material is adapted to be positioned adjacent to the rafter in the attic, and at least a portion of the venturi collar is disposed within the insulating material; and at least one strap, said strap is adapted to suspend the fan and the elongated, flexible acoustically insulating material from the rafter, said strap attenuates the vibration generated from the fan.

2. The system of claim 1, wherein said fan is a duct fan.

3. The system of claim 1, wherein said fan is a propeller fan.

4. The system of claim 1, wherein said air admitting device is a register.

5. The system of claim 1, wherein said air admitting device is a diffuser.

6. The system of claim 1, further comprising a damper, said damper having a plurality of shutters that can be moved to a closed position by gravity.

7. The system of claim 6, wherein said damper is made of a heat insulating material.

8. The system of claim 6, wherein the damper is positioned downstream from the fan.

9. The system of claim 1, wherein the elongated, flexible acoustically insulating material comprises an acoustically insulating duct.

10. The system of claim 9, wherein the fan motor is positioned inside the duct.

11. The system of claim 1, wherein the length of the elongated insulating material is about 6 feet long.

12. The system of claim 1, wherein the length of the elongated insulating material is at least 2 feet long.

* * * * *